US006672556B1

(12) United States Patent
Hsia

(10) Patent No.: US 6,672,556 B1
(45) Date of Patent: Jan. 6, 2004

(54) READING DEVICE

(76) Inventor: Chih-Yu Hsia, 301 Warren Way, Arcadia, CA (US) 91101

( * ) Notice: Subject to any disclaimer, the term of this patent is extended or adjusted under 35 U.S.C. 154(b) by 0 days.

(21) Appl. No.: 09/608,929

(22) Filed: Jul. 3, 2000

Related U.S. Application Data

(63) Continuation-in-part of application No. 09/352,644, filed on Jul. 10, 1999, now abandoned.

(51) Int. Cl.[7] ..... A47B 97/04
(52) U.S. Cl. ..... 248/447; 248/454
(58) Field of Search ..... 248/447, 441.1, 248/446, 454, 457, 447.2, 125.8; 353/98; 359/682

(56) References Cited

U.S. PATENT DOCUMENTS

| | | | | |
|---|---|---|---|---|
| 1,559,366 A | | 10/1925 | Phelps, Jr. | |
| 1,647,930 A | | 11/1927 | Petrick et al. | |
| 3,003,731 A | | 10/1961 | Balch et al. | |
| 3,514,066 A | | 5/1970 | Singleton et al. | |
| 3,889,914 A | | 6/1975 | Torme | |
| 4,310,149 A | | 1/1982 | Camilleri | |
| 4,531,813 A | * | 7/1985 | Van der Berg | 350/623 |
| 4,577,819 A | | 3/1986 | Bennett | |
| 4,605,291 A | * | 8/1986 | Jolly | 350/623 |
| 4,987,690 A | | 1/1991 | Aaldenberg et al. | |
| 5,433,376 A | | 7/1995 | Kueshner | |
| 5,471,264 A | | 11/1995 | Hsia et al. | |

* cited by examiner

*Primary Examiner*—Ramon O. Ramirez
(74) *Attorney, Agent, or Firm*—William W. Haefliger

(57) ABSTRACT

An apparatus, which facilitates viewing of an object by a reclining human user, comprising an upright stand, a hinge device, a beam hinged to the stand by the hinge device, a spring linking the stand and the beam, a carrier for an object, the carrier supported so that the object faces forwardly, a carrier connecting with the beam, and a stop on the stand top positioned to limit down hinging movement of the beam that moves the carrier downwardly, there being a guide supporting a lower portion of the beam for hinging movement carrying that beam lower portion to one side of the stand in uppermost position of the beam.

7 Claims, 6 Drawing Sheets

READING DEVICE

This application is a continuation-in-part of prior pending U.S. patent application Ser. No. 09/352,644, filed Jul. 10, 1999, now abandoned.

BACKGROUND OF THE INVENTION

This invention relates to a device that helps a user to comfortably read a book while lying on a bed.

Reading a book while lying down on a bed sometimes is tiresome, because it requires that the arms and hands constantly hold up the book. This is especially true when one has to read a thick and heavy book while lying down. There is need for improved means or apparatus that alleviates this problem, in a simple effective useful and improved manner.

U.S. Pat. No. 5,471,264 to Hsia et al. disclosed apparatuses to facilitate reading of a book or the like by a reader looking upwardly at reflections of the book via two mirrors. These apparatuses teach combinations of support means, a book carrier, and two mirrors to facilitate reading of a book. However, in using an apparatus, the book carrier, the two mirrors and a portion of the support means will be near or above the body of a user. These portions of the apparatus would sometimes hinder the user's movements. The apparatuses introduced by Hsia et al. did not teach use of only a support means and a book carrier to facilitate the book reading. Neither did these apparatuses teach means such that a portion of the support means, when not being used, can automatically return to a position which relatively reduces the apparatuses' hindering the movements of a user.

Also, prior devices lacked a simple stop at a stand top, positioned to limit down-hinging movement of a beam that moves a book carrier to face forwardly; nor did prior carriers have a hinge device connected to a stand, at its uppermost extent to allow the beam to flatly downwardly engage a stop upon down-hinging movement of the beam, from an upright out-of-the way beam stored position.

SUMMARY OF THE INVENTION

Basically, the apparatus of the invention comprises a) support means, b) a carrier for a book or the like, the carrier supported by the support means for swinging between two positions so that the book or the like faces forwardly.

The invented device can support a book or the like so that reading while lying on a bed can be more enjoyable. The invented device also provides means to automatically, return the carrier when not in use to close to a standup position so that the carrier will not be in the way of the user. An object other than a book can be used.

These and other objects and advantages of the invention, as well as the details of an illustrative embodiment, will be more fully understood from the following specification and drawings, in which:

DRAWING DESCRIPTION

Figure 4:
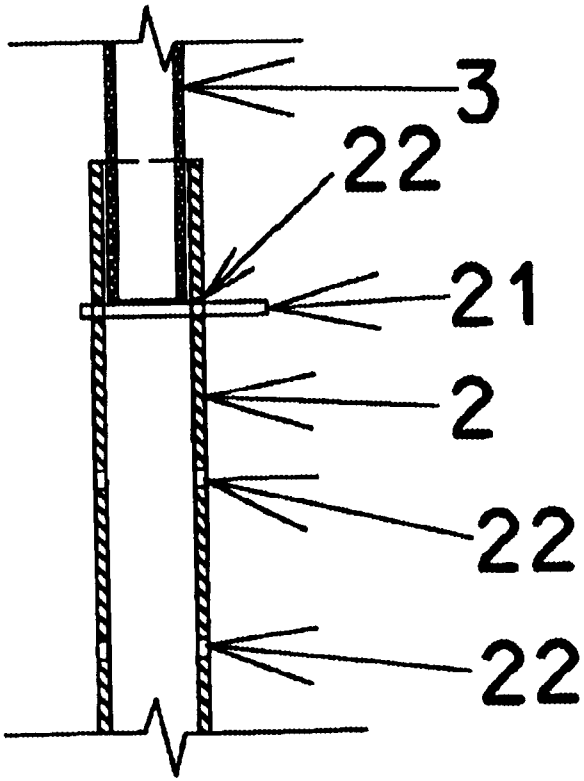
Figure 3:
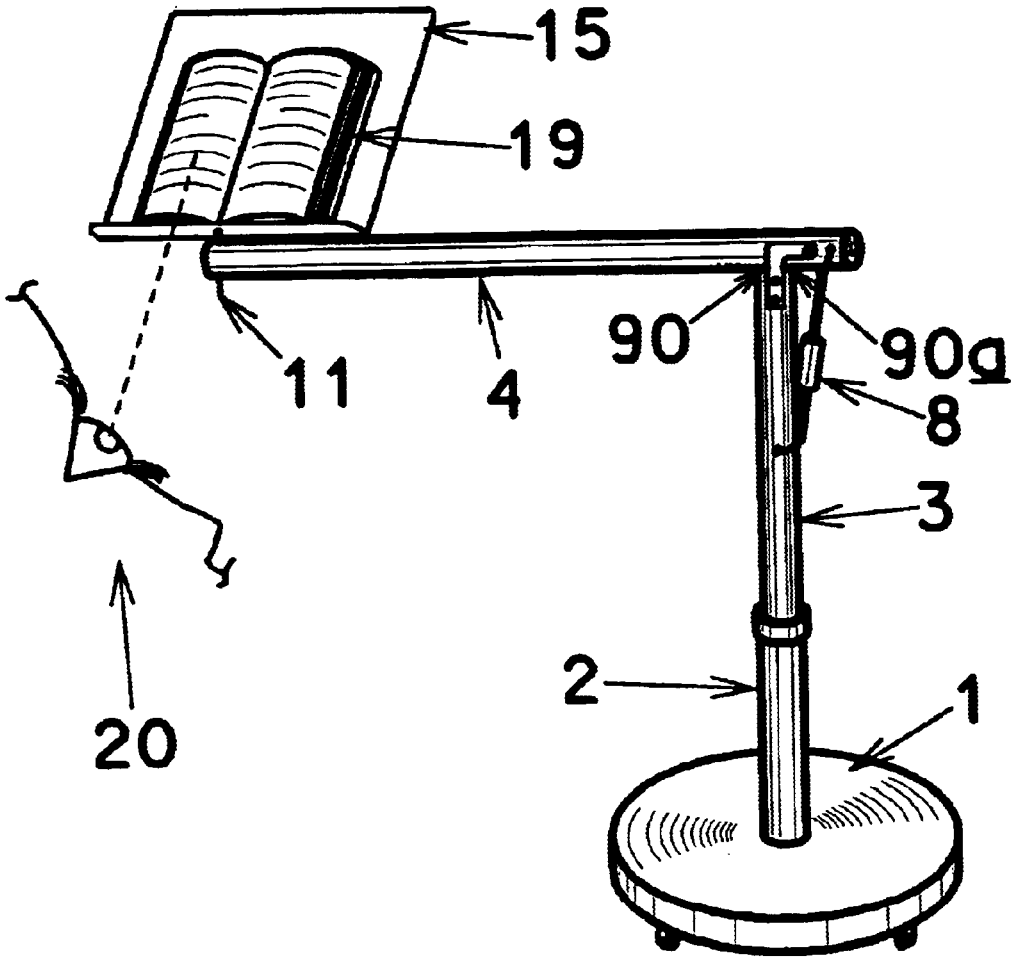
FIG. 3 is an isometric view that illustrates the operational functions of the invented device shown in FIG. 1.
Figure 3A:
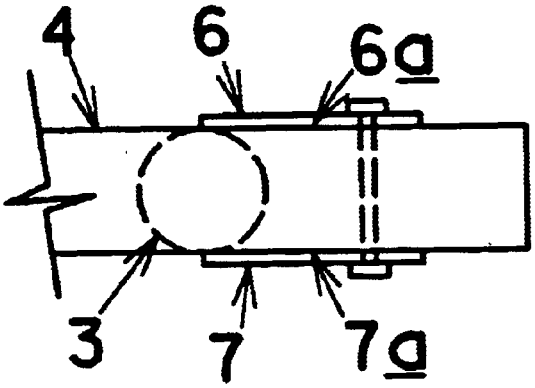
Figure 5:
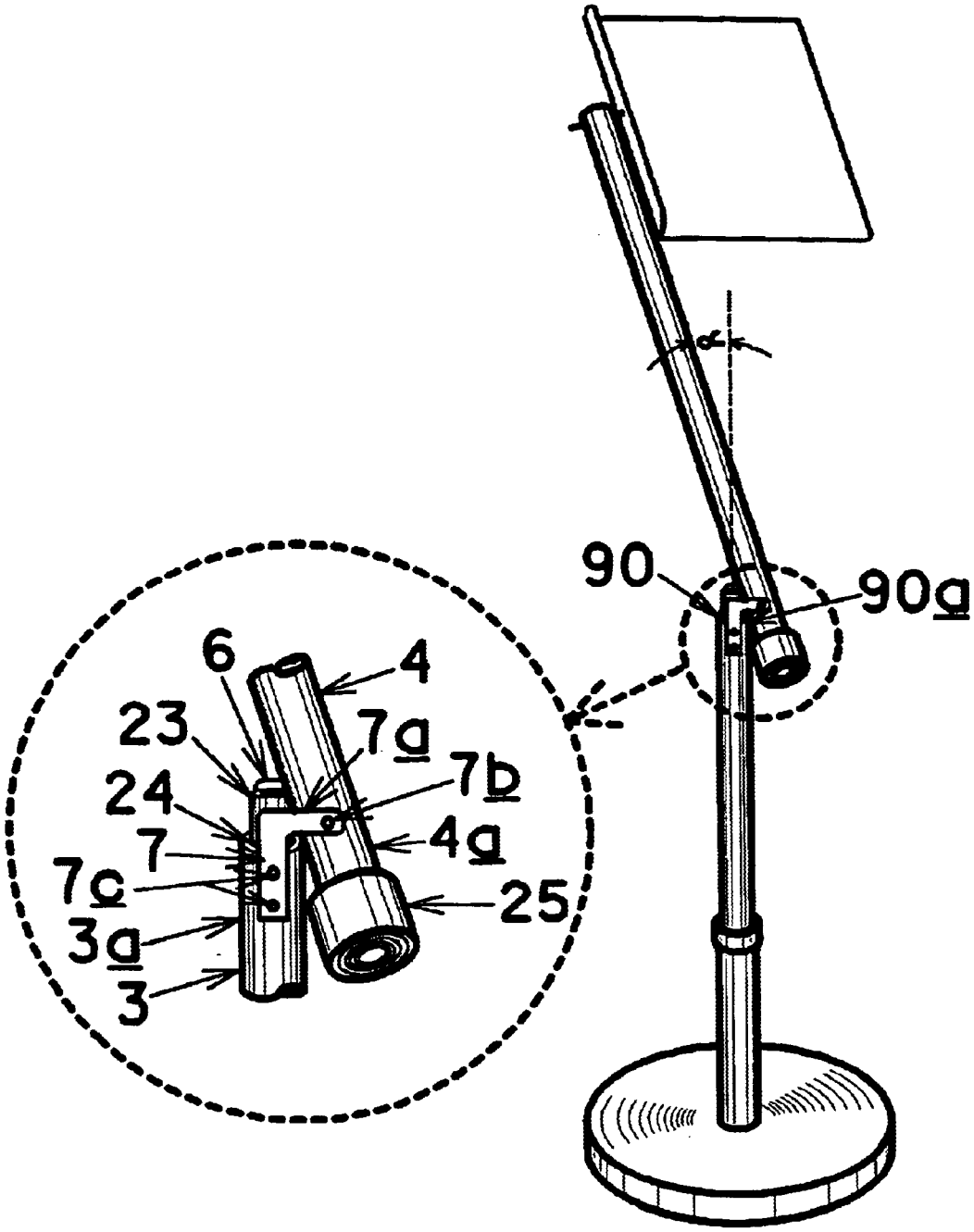
Figure 6:
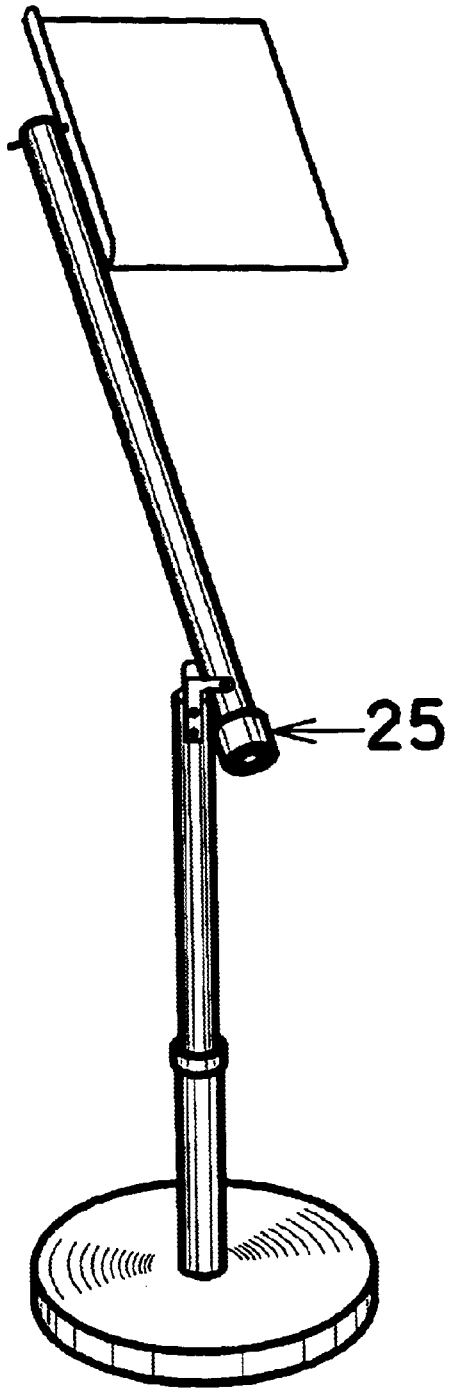
Figure 7:
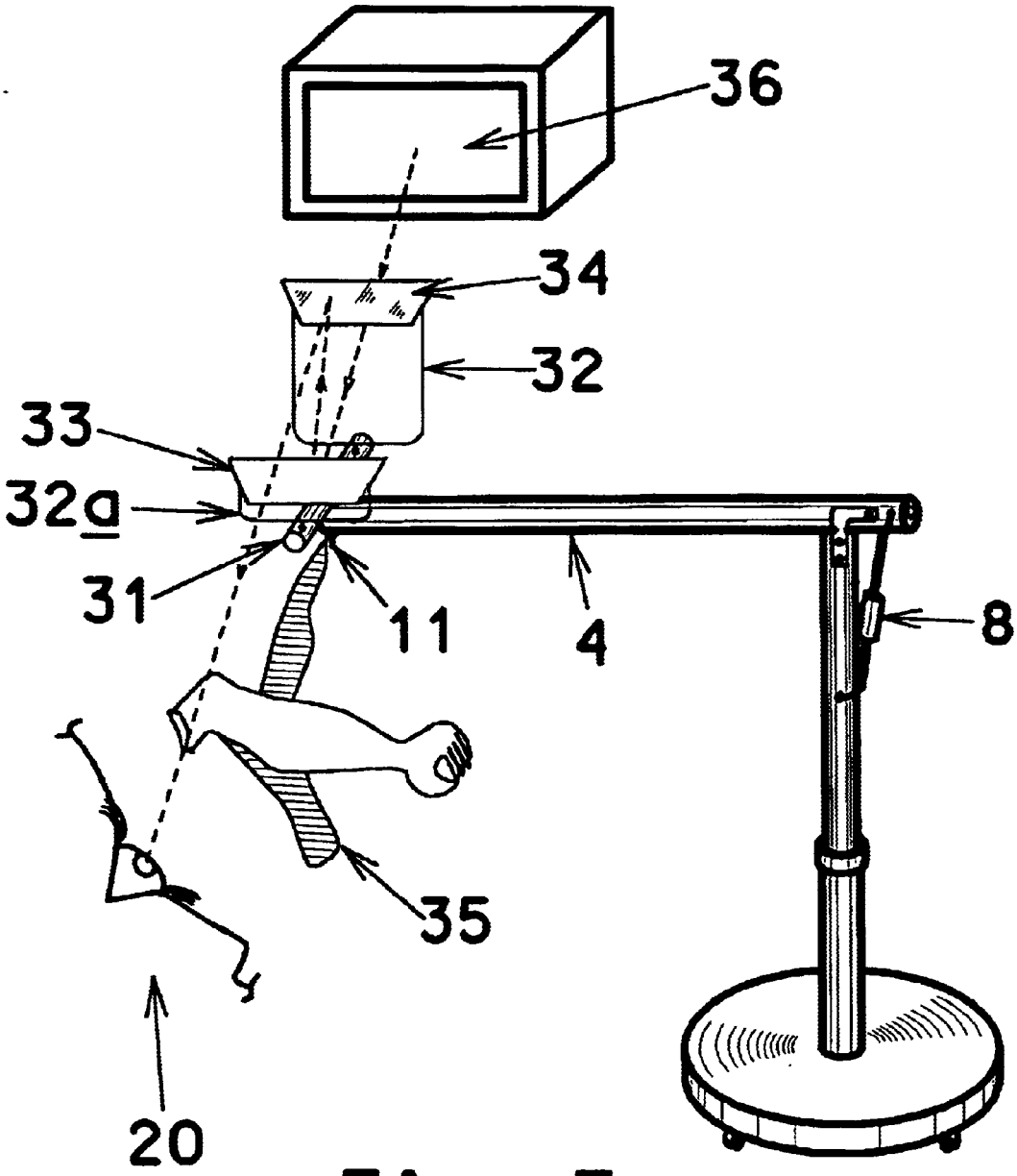

FIG. 3*a* is a fragmentary top plan view showing beam guiding to lowered position;

FIG. 4 is a sectional view of a variation of the telescopic connection of the support means;

FIG. 5 is an isometric view of the second variation of the invented device;

FIG. 6 is an isometric view of the third variation of the invented device; and FIG. 7 is a perspective view of a modified form of the reading device, with double mirrors.

DETAILED DESCRIPTION

Four variations of the invented devices are described herein.

Figure 1:
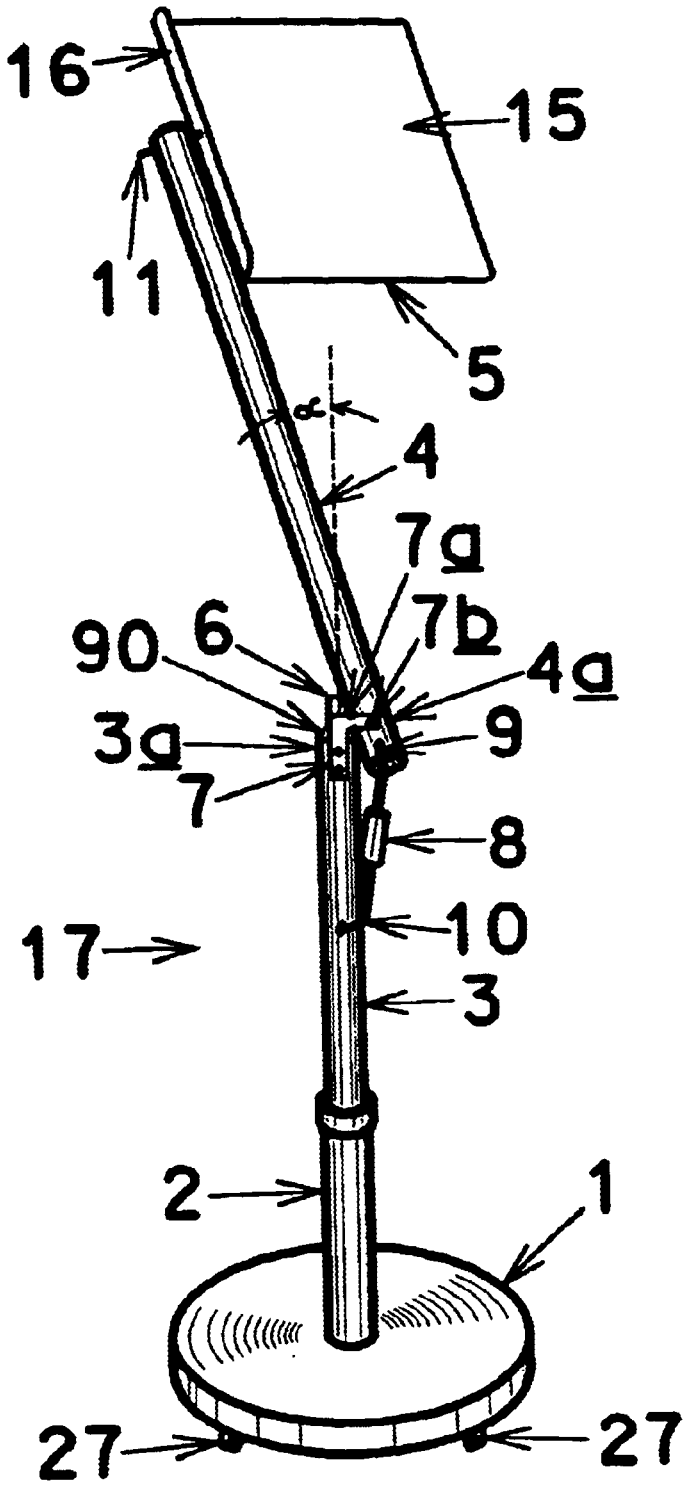
FIG. 1 is an isometric view of the invented device.

Referring to FIG. 1, the support means 17 includes a base 1, a stand which may include a lower column 2 and an upper column 3, a beam 4, two hinge connectors 6 and 7, a spring 8, and a pair of spring links 9 and 10. The carrier 5 includes an upright back panel 15 against which the book rests, and a forwardly extending ledge 16 at the base of panel 15, to support the book's lower edge or edges. A single clamp or clamps may be used to retain the open book to the panel, or to the ledge. A small lamp may be included for illumination of the book.

The base 1, which may be of any suitable shape and size, supports the stand which consists of telescopically connected lower column 2 and upper column 3. The base may optionally have roller means in the form of casters 27. The casters may swivel about vertical axes, and may be spaced apart in horizontal directions whereby upsetting the support of the entire unit is prevented. Each of the two hinge connectors 6 and 7 is a L-shaped object which one leg connects to the upper column near the upper column's upper end. The other leg of the L-shaped object hinges with the beam 4 near one of the beam's ends. The spring 8 is a spring preferably with a damper. The spring has links 9 and 10 which are hooks. The spring link 9 links the upper end of the spring to near the end of the beam 4. The connection location of the spring link 9 is closer than that of the hinges to the same end of the beam. The spring link 10 links the other end of the spring to the upper column. The middle of the ledge 16 of the carrier is pinned, by the connecting pin 11 which is either a pin, a rivet, or a bolt and a nut unit, to the beam near the beam's end.

The carrier is connected near one end of the beam while the hinge connectors 6 and 7 are near the other end. The carrier can be pivoted along the connecting pin.

Also as shown in FIG. 1, and also in FIG. 5, the connector or bracket 7 is shown to have a leg 7*a* extending to the upper right side of column 3. A hinge pin 7*b* extends through the lower end portion 4*a* of the beam 4, such that the lower end portion 4*a* extends adjacent the upper side 3*a* of the column 3. That side 3*a* limits upward swinging of the beam to extend at angle $\propto$ relative to vertical, in uppermost position of the beam. That angle $\propto$ is between 5° and 20°. This prevents over-center up-swinging of the beam. A very compact, multi-functional connection of the beam to the column upper end is thereby provided, with horizontal and upright beam swinging stops 90 and 90*a* provided on the column upper end.

FIG. 3 shows the beam side abutting the top of the column 3, positively stopping further down-swinging of the beam. Such swinging is guided by the horizontal leg 7*a* of bracket 7, and also by a like leg 6*a* of bracket 6. FIG. 5 shows bracket upright lower leg 7*b* attached by fasteners 7*c* to the column 3 so that leg 7*a* is located above the top of the column, and guides the beam during its down-hinging movement. See also FIG. 3*a*.

Figure 2:
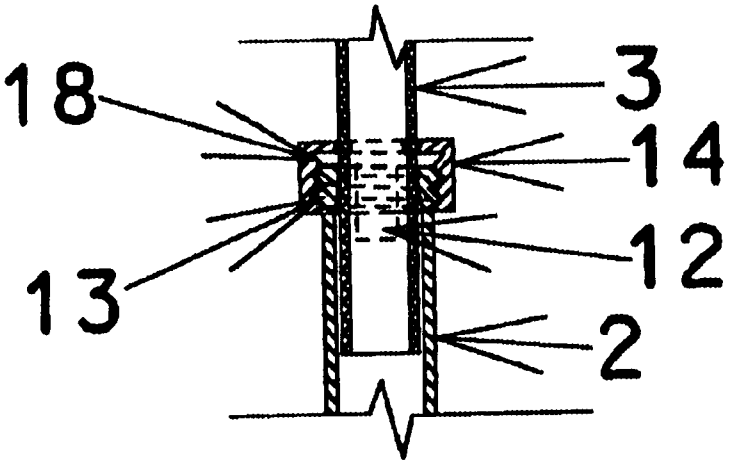
FIG. 2 is a sectional view of a telescopic connection for the support means shown in FIG. 1.

Referring to FIG. 2, the upper column 3 telescopes with the lower column 2 in a way that the screw cap 14, which has screw threads 18, tightens and fastens the conjugated screw threads 13 of the lower column. The opening 12 is one of the cuts which is near the upper end of the lower column. The openings allow the upper end of the lower column to be squeezed to fasten the upper column. The upper column can be twisted and turned along the centerline of the lower column.

Referring to FIG. 3, when the user puts a book 19 on the carrier, the weight of the book will lower the beam. When the beam reaches the top end of the upper column, the end of the upper column will stop and support the beam. The invented device then can support the book. The user 20 who lies down on a bed or a sofa (this part not shown) can comfortably read the book without hand supporting the book. The abilities that 1) the carrier can be turned on the beam, 2) the upper column can be twisted on the lower column, and 3) the upper column can be raised or lowered into the lower column enable the user to adjust the position of the book for comfortable reading.

The removal of the book's weight, after the user finishes reading and removes the book from the carrier, and the continuous pull of the spring 8 will cause the beam to pivot upwards to FIG. 5 position such that the carrier and the beam can be upright in their original FIG. 5 positions before use as in FIG. 3. This will move the beam and the carrier away from the user and will automatically minimize the hindering of the device to the movements of the user. The optional damper associated with the spring, when so equipped, will make the upright motion in a slow manner.

Referring to FIG. 4, the upper column 3 telescopes with the lower column 2 in a way that the lower end of the upper column rests on a pin 21 that penetrates through a pair of holes 22 on the lower column. The upper column is not only supported by the pin 21 but also can be turned along the centerline of the lower column. The pin 21 can be moved to penetrate through other pairs of holes on the lower column so that the total lengths of the upper column and the lower column can be adjusted. This is turn makes the vertical locations of the carrier to be adjustable.

Referring to FIGS. 1 and 5, in lieu of the spring 8 and the spring links 9 and 10, a spring 23 is used for the variation of the invented device. The spring 23 rests partially in a recessed area 24 on the upper end of the upper column. When a book is put on the carrier of this variation, the beam will be lowered due to the weight of the book. The spring will be compressed while the beam rests on the rim of the recessed area 24 of the upper column, providing stop 90. The book will be supported by the carrier and the support means. When the book is removed, the spring will push the beam back into its upright position. The spring may be equipped with a damper.

Referring to FIGS. 1 and 6, in lieu of the spring 8 and the spring links 9 and 10, a counter weight 25 is used for the variation of the invented device. The counter weight is mounted near or on the end of the beam as shown. When a book is put on the carrier of this variation, the beam will be lowered due to the weight of the book. The beam will rest on the upper end of the upper column. The book will be supported by the carrier and the support means. When the book is removed, the counter weight will pull the beam back into its upright position.

Referring to FIG. 5, a spring 23 and a counter weight 25 can be provided to the invented device for automatically returning the carrier and the beam back to their positions before the use.

All of the variations of the invented devices can have the telescope connections described as shown in FIGS. 3 and 4.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

Further objects of the invention include provision of:

a) a support movable between two positions by a user, b) a mirror carried by the support, c) and a cathode ray tube having a screen positioned in a light transmission path established between the screen and the mirror when the support is in one of said two positions, at which time the screen is viewable by a user looking at the mirror, d) said light transmission path being interrupted when the support is in the other of said two positions.

The support is typically a swingable beam, and including a hand manipulable component on the beam to enable hand swinging of the beam by a reclining user. A second mirror may be carried by the support to be in said light transmission path, when the support is in said one position, as for example when a reclining user moves the support to said second position.

In the example shown in FIG. 7, a sub-beam or support 31 is carried by the swingable beam 4. The support 31 supports two racks 32 and 32*a* which support two mirrors 33 and 34 respectively. Support 31 is mounted near the end of the beam 4, by means of a bolt, nut and washer assembly 11. The racks extend upward to different heights, so that the mirrors are not in the same plane or at the same elevation. The two mirrors are facing towards each other. A string or a strip of cloth 35 is attached to the end of the beam 4, for hand manipulation, as by gripping.

In use, a human user 20 pulls down on the beam 4. Then the user uses his/her hand to hold the string or the strip of cloth 35. This will keep the beam 4 in the down (or horizontal) position. Then the user realigns the beam 31 and the mirrors 33 and 34 such that the image of a television screen 36 is reflected by the mirror 33 onto the mirror 34. The user then can watch the television from the mirror 34. When the user finishes watching the television, the user just needs to let go of the string or the strip of cloth 35. The spring 8 will return the beam 4 in its original near vertical position.

I claim:

1. An apparatus, which facilitates viewing of an object by a reclining human user, comprising in combination:

a) support means including i) an upright stand, configured as a column, ii) a hinge device, iii) a beam hinged to the stand by the hinge device, iv) a spring linking the stand and the beam, b) a carrier for said object, the carrier supported by the support means so that the object faces forwardly, c) said carrier connecting with said beam, d) and a stop on the stand top positioned to limit down hinging movement to approximately horizontal position of the beam that moves the carrier downwardly, there being a guide supporting a lower portion of the beam for hinging movement carrying that beam lower portion to one side of the stand in uppermost position of the beam, said spring extending proximate said guide, e) said stand comprising two segments telescopically connected to each other whereby said two segments have adjustable connections which allow upward and downward shifting and twisting of one segment relative to the other segment, f) and including a base supporting said stand and roller means that support the base to allow adjustably horizontal positioning of said stand, g) said guide comprising a first L-shaped bracket having a substantially horizontal leg hingedly connected to said beam lower portion, at one side of the column, and having an upright leg connected to one side of the column, whereby the horizontal leg is located above the level of the top of the column to guide the beam during its down-hinging movement, h) and including a second L-shaped bracket like said first bracket, and having a substantially horizontal leg hingedly connected to said beam lower portion, and having an upright leg connected to the opposite side of the column, said beam lower portion guided for swinging between said two horizontal legs of the two brackets, in offset relation to said top.

2. The combination of claim 1 including said object which is a first mirror viewable by said user when said beam is in a lowered position, and a cathode ray tube having a screen positioned in a light transmission path between the screen and the first mirrors when the beam is in said lowered position said carrier carrying said object.

3. The combination of claim 2 including a second mirror in the light transmission path between the screen and said first mirror, and supported by the stand.

4. An apparatus, which facilitates reading of a book by a reclining reader, comprising a) support means including:
i) an upright stand,
ii) a hinge device, and
iii) a beam hinged to said stand by said hinged device, b) a carrier for said book, the carrier supported by the support means so that the book faces forwardly, c) said carrier connecting with said beam, d) the stand having a top, and including a stop on the stand top positioned to limit down hinging movement of the beam that moves the carrier downwardly, e) said stop located proximate the uppermost extent of the stand, f) and a spring directly linking said stand and said beam to return the beam to an upright position when the book is removed from the carrier, g) said hinge device connected to the stand, at its said uppermost extent, and connected to said beam in offset relation to said stop, to allow the beam to flatly downwardly engage said stop upon said down hinging movement of the beam, said device having legs to guide the beam during its swinging movement, h) and including a base supporting the stand, and wherein said base has roller means that allow adjustably horizontal positioning of said stand.

5. The combination of claim 4 including a base supporting the stand, and wherein said base has roller means that allow adjustably horizontal positioning of said stand.

6. The combination of claim 1 including said object which is one of the following:

i) a book ii) an object carrying legible printing or writing iii) a mirror for reflecting a viewable scene.

said carrier carrying said object.

7. In combination:

a) a support movable between two positions by a user, b) a mirror carried by the support, c) and a cathode ray tube having a screen positioned in a light transmission path established between the screen and the mirror when the support is in one of said two positions, at which time the screen is viewable by a user looking at the mirror, d) said light transmission path being interrupted when the support is in the other of said two positions, e) and wherein the support is a swingable beam having a downwardly limited horizontal position of engagement with a stand top, and including a hand manipulable component on the beam to enable hand swinging of the beam by a reclining user, f) and including a second mirror carried by the support to be in said light transmission path when the support is in said one position.

* * * * *